United States Patent [19]

Colditz

[11] 4,449,435

[45] May 22, 1984

[54] APPARATUS FOR BUNCHING AND SEVERING WIRE COILS

[75] Inventor: Werner Colditz, Duisburg, Fed. Rep. of Germany

[73] Assignee: Mannesmann Aktiengesellschaft, Dusseldorf, Fed. Rep. of Germany

[21] Appl. No.: 367,773

[22] Filed: Apr. 12, 1982

[30] Foreign Application Priority Data

Apr. 23, 1981 [DE] Fed. Rep. of Germany ..... 3116089

[51] Int. Cl.[3] ..... B21F 11/00

[52] U.S. Cl. ..... 83/167; 83/262; 83/598; 83/623; 83/907

[58] Field of Search ..... 83/907, 18, 175, 167, 83/580, 564, 262, 598, 623

[56] References Cited

U.S. PATENT DOCUMENTS 3,360,842 1/1968 Hill et al. ..... 29/200
3,581,368 6/1971 Gilvar ..... 83/907 X
3,776,076 12/1973 Hauck ..... 83/907 X
4,011,780 3/1977 David ..... 83/907

FOREIGN PATENT DOCUMENTS 1499013 4/1970 Fed. Rep. of Germany .
1527822 12/1970 Fed. Rep. of Germany .

*Primary Examiner*—Donald R. Schran
*Attorney, Agent, or Firm*—Mandeville and Schweitzer

[57] ABSTRACT

A wire coil bunching and severing apparatus has an intermediately located pair of bottom halves which project into the bunching shaft. The side wall of the shaft, near the bottom halves, is provided with two sets of shears. The bottom halves are formed with edges which, when projected into the shaft, cover substantially all of the shaft cross section, with the exception of areas near to the shears. Wire strands will be thus guided by the edges of the bottom halves to the cutting shears for severing.

2 Claims, 2 Drawing Figures

APPARATUS FOR BUNCHING AND SEVERING WIRE COILS

BACKGROUND OF THE INVENTION

The present invention relates to an apparatus for collecting and separating wire coils or strands and other similar objects, which are gathered together in bunches on a collecting shaft of a bunch collecting station. The bunches are collected on a collect post. After a certain predetermined amount of wire coils are collected on the post, a horizontal, platform-shaped, intermediately located bottom projects into the cross section of the shaft and guides the wire coils to one of a pair of shears for cutting. Alternatively, a catching bolt can be inserted above the selectively projecting bottom element for supporting the coiled wire during the cutting process. The wire is guided by the intermediately located, laterally movable bottom, to the shears for cutting the wire strand located between the wire coil bunches.

DESCRIPTION OF THE PRIOR ART

Apparatus is available for the manufacture of bunches of rolled wire or coils. Basically, the apparatus comprises a bunch-collector station fed with wire windings which are fanned out, for example, from a cooling track and supplied by a horizontal conveyor. The bunch-collecting station generally operates in a vertically disposed cylindrical shaft in which the wire bunches are collected. In the manufacture of coiled wire, each metal rod is rolled out to the length of the wire. Therefore, the weight of the finished coiled wire bunch corresponds to the weight of the unrolled rod. In up-to-date wire rolling mills, large rod weights are used which consequently increase the weight of the coiled wire bunches. Since most buyers of coiled wire do not want excessively large individual wire bunches, it is necessary to bunch, cut and sever the bunches from one another according to the dimensions of the desired end product.

Because of the overlapping nature of the coiled metal windings, it is extremely difficult to bunch, cut and sever the wire windings as they move on a conveyor belt. Therefore, prior art bunch separation devices operate mainly in the bunch-forming, cylindrical, vertically arranged shafts or chamber. To this end, equipment is arranged within the chamber or shaft and in the dropping plane of the coiled wire. This equipment may, according to the specified capacity and speed of the station, be arranged in the form of an intermediate bottom on which the wire windings come to rest. Alternatively, catch bolts or catch arms may be pivoted or inserted into the dropping plane of the wire to interrupt the otherwise downward flow of the coils. In any case, the wire caught in this manner will be still connected by a single strand to the downstream lying bunch which already lies below the intermediate bottom floor. To separate the connected together bunches into individual bunches, the single strand is severed by an appropriate piece of severing equipment.

German Pat. No. 15 27 822 provides catching bolts and an intermediately located bottom for the purpose of intermediate storage of bunches. The catching bolts are for the purpose of forming bunches at high feeding speed in a horizontal plane in the shaft of the bunch-forming chamber. The bolts may be selectively inserted and retracted to selectively catch the coiled wire and to maintain proper bunching control. The intermediate bottom of the reference is designed as a pair of plates which overlap the cross sectional area of the chamber or shaft. The bottom is provided with forwardly located, side recesses through which the wire may extend between bunches. The wire is thus directed into the cutting area for severing by a pair of shears. This cutting area is circumscribed by plate segments having a U-shaped recess which is vertically pivotally arranged outside the shaft. The plate segments are intended to catch the wire winding strand within the recess area to move the strand through a lateral longitudinally slit of the cylinder wall and directly to the wire shears arranged outside the cylinder wall.

The known prior art has the disadvantage, that the wire, being in any one cross sectional area of the shaft, is guided, with the help of the intermediary bottom, through the entire cross section of the shaft. The guided path can, on occasion, be equal to the entire perimeter or circumference of the shaft. Particularly when the wire winding strand, separating the bunches, is in the half of the shaft facing away from the shears, there is the possibility of interference in the smooth bunch-forming process. This can result in coils or windings becoming twisted or kinked. A further disadvantage lies in the fact that the plate segments, the motions of which must be coordinated with the shifting of the intermediate bottom, represent an additional construction expense and do not, however, insure that the captured wire strand will be fed properly to the severing shares.

It is also known from German Pat. No. 14 99 013 to form the intermediate bottom of two halves which are guided on a horizontal plane from both sides of the shaft into said shaft. As thus guided, only a narrow gap remains between the edges of the intermediately projected-in bottom halves. The wire strand to be cut is positioned in that gap and merely has to be guided to the severing apparatus, generally a shears. To this end, catch arms are provided at two sides of the bunch-forming chamber, each of the catching arms serving to skim across half of the gap remaining between the intermediate bottom halves, to thereby feed the wire, according to the initial position of said wire, to one or the other of two shears arranged on both sides of the gap. This apparatus is less disadvantageous than the previously mentioned prior art, because the wire must now only be moved, in each instance, only across one-half of the cross section of the shaft, namely, across only that half of the shaft in which the wire is already located. In any event, however, additional catching equipment must be mechanically coordinated which must be designed of smaller dimensions than the plate segments of the first described reference which, however, must be present in unduly duplicate amounts. While work may proceed at a fast pace with the prior art device, an interference factor must, however, be recognized because of the required coordination between the motion of the intermediate bottom halves, the catching arms and, if present, both of the shears.

SUMMARY OF THE INVENTION

Assuming as background the briefly described state of the prior art and the briefly described disadvantages, the object of the present invention is to create an apparatus for severing or cutting wire winding or coil strands. The present invention apparatus, while of considerably single design than the prior art, assures that the wire is safely fed to the severing apparatus, therefore not only being more economical in construction cost or expense but, in addition, also being less subject to interference during operation.

In order to solve the problem, according to the present invention, the intermediate bottom is formed of two halves movable in counter-direction to each other. Their leading edges, which are in the bunch forming shaft when the collecting bottom halves are in their inwardly projected position, overlap each other, except for the area which is approachable by the separating equipment, i.e., the shears. The edges of the bottom halves, in relation to the direction of motion, extend laterally to the near and guide the wire to the shears as the collecting bottom halves close, i.e., are projected into the chamber of shaft.

The proposed solution, therefore, eliminates the feeding mechanism for the wire. According to the previously described state of the art, the feeding mechanisms are designed as catch arms or plate segments. According to the present invention, however, the feeding mechanism is thus completely avoided because the wire is guided simply and safely through the halves of the intermediate bottom and into the area of one of the two shears.

It has proved particularly advantageous that, according to another characteristic of the invention, the edges of the intermediate bottom halves have the outline, in topview, of an isoceles triangle, the leading points of which lie on the main axis of the shaft arranged in the direction of motion of the collecting bottom halves.

The present invention helps create a feeding apparatus which automatically guides the wire strand, irrespective of its initial position in the shaft, to either one or the other side and into the area of one of a pair of shears. The apparatus, according to the invention, is distinguished by its particular simplicity because it essentially comprises a divided collecting bottom which is powered by hydraulical cylinders and rods and movable on horizontal tracks. Since separate feed devices, i.e., physically separated from the collecting bottom are no longer required, the stop-and-sever time of the cutting process for coil bunches is considerably shortened, so that the apparatus may not only be constructed at lower cost because of its simple design but is also more economical to run.

An exemplary embodiment of the present invention is represented in the drawing as follows:

DETAILED DESCRIPTION OF THE DRAWING

Figure 1:
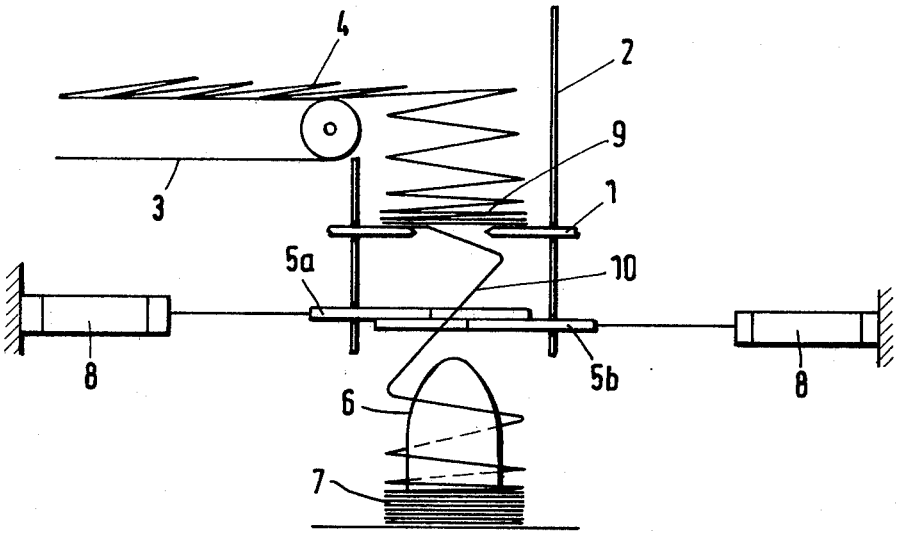
FIG. 1 is a side elevational view of the preferred embodiment for the apparatus of the present invention for bunching and separating the wire coils or strands.

The side catch bolts 1 of a bunch-collecting apparatus are shown in FIG. 1. The conveyed wire coils or windings 4 are ejected, in a fanned-out orientation, from a conveyor 3 located in shaft or chamber 2 of the apparatus. With the collecting bottom halves 5*a* and 5*b* open, i.e., retracted, and with catch bolts 1 also retracted, the coils or windings 4 will drop onto a collecting post 6 below the shaft 2, thereby forming a coiled bunch 7.

When the coiled bunch 7 reaches the desired height on the post 6 or, if applicable, the desired weight, either the catch bolts 1 are projected toward one another, i.e., they are moved into the position represented in FIG. 1 with the aid of piston-cylinder units, or the collecting bottom halves 5*a* and 5*b* are moved into the projected (as opposed to retracted) position by piston-cylinder units 8. Piston-cylinder units 8 engage bottom halves 5*a* and 5*b* in pairs, at the collecting bottom halves 5*a* and 5*b*, thereby gathering the additionally conveyed wire coils or windings 4 into a second bunch 9, as indicated. The second bunch 9, therefore, collects on the collecting bottom halves 5*a* and 5*b* or on the catching arms 1. There is a wire connection or wire strand 10, of course, between the finished bunch 7 and the second bunch 9, which wire strand 10 passes through the collecting bottom halves 5*a* and 5*b*.

Figure 2:
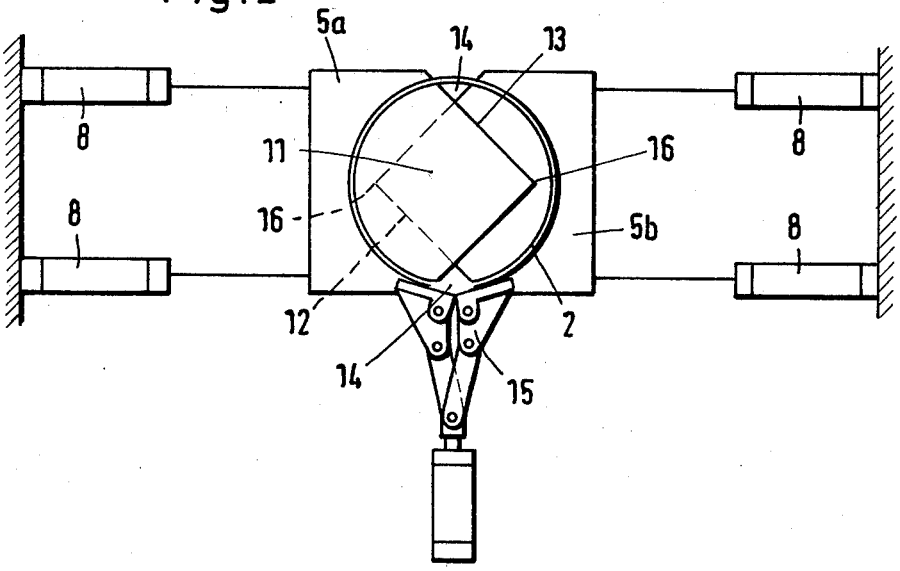
FIG. 2 is a top plan view of the apparatus shown in FIG. 1.

FIG. 2 shows that the collecting bottom halves 5*a* and 5*b* overlap one another over the cross area of the shaft 2. The overlapped area 11 is defined by edges 12 and 13 of bottom halves 5*a* and 5*b*. Small areas 14 are not overlapped by bottoms 5*a* and 5*b*. Small areas 14 are overlapped, in each case, by a hydraulically operated pair of shears 15 (not shown in FIG. 1) which shears sever the wire strand 10 which was pushed by the edges 12 and 13 into the shearing areas 14.

As is also shown in FIG. 2, the edges 12 and 13 of the collecting bottom halves 5*a* and 5*b* act as feeding apparatus and are designed as isoceles triangles, the points 16 of which point in the direction of the closing motion. Since the vertices or points 16 of the collecting bottom halves 5*a* and 5*b* are designed, as stated, and are arranged on the main axis arranged in the motion direction of the collecting bottom halves 5*a* and 5*b*, and the edges 12 and 13, starting from the vertices 16, in relation to the direction of motion when a collecting bottom half 5*a* or 5*b* closes, i.e., the edges extend obliquely to the rear, the wire strand is guided, each time, according to its position in the shaft between the edges 12 and 13 of the collecting bottom halves 5*a* and 5*b*, either to one or to the other side of the shaft and into the area 14, where it is severed by a closing of the shears 15 (the drawing only shows one of the two shears).

The teachings of the attached copy of the corresponding German Application, upon which this application claims priority, is herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An apparatus for severing strands of continuous wire coils to create individual wire coil bunches, comprising:

(a) a cylindrically-shaped wall defining a vertical shaft;

(b) a wire bunch collecting station located at the bottom of said shaft;

(c) a wire bunch collecting shelf located above said bottom, said shelf comprising two opposed, symmetrical and similarly shaped edge defined halves, one of said halves being vertically offset with respect to the other of said halves;

(d) said halves being selectively reciprocable into said shaft from a first fully retracted position to a second projected position, said second projected position causing said halves to overlap one another and substantially cover the cross section of said shaft, the uncovered section of said cross section of said shaft defining two wire strand cutting areas; and (e) a pair of cutting shears located at the same level, in said shaft, as said shelf, one of said pair being located at each of said cutting areas.

2. An apparatus for severing wire coils, as claimed in claim 1 wherein:

(a) said edges of said halves define isoceles triangles, the points of which are located on the main axis of said shaft.

* * * * *